United States Patent [19]

Tack

[11] Patent Number: 4,951,325

[45] Date of Patent: Aug. 28, 1990

[54] TOILET SEAT RETURN DEVICE

[76] Inventor: Newton G. Tack, 202 Three Degree Rd., Butler, Pa. 16001

[21] Appl. No.: 455,089

[22] Filed: Dec. 22, 1989

[51] Int. Cl.[5] ..... A47K 13/10

[52] U.S. Cl. ..... 4/251; 16/84

[58] Field of Search ..... 4/248, 251, 253; 16/73, 16/74, 75, 76, 84, 86 R, 86 A, DIG. 17; 248/205.9

[56] References Cited

U.S. PATENT DOCUMENTS

| | | | |
|---|---|---|---|
| 2,147,364 | 2/1939 | Brock | 4/248 |
| 2,419,449 | 4/1947 | Hilton | 16/86 A |
| 2,477,378 | 7/1949 | Jurinak | 4/248 |
| 4,053,961 | 10/1977 | Wilson et al. | 16/84 |
| 4,220,266 | 9/1980 | Braden et al. | 16/84 X |
| 4,477,933 | 10/1984 | Leckie | 4/253 |
| 4,519,105 | 5/1985 | Blanck | 4/251 X |
| 4,577,350 | 3/1986 | Clark | 4/251 |

FOREIGN PATENT DOCUMENTS

| | | | |
|---|---|---|---|
| 637678 | 4/1962 | Italy | 16/84 |

*Primary Examiner*—Henry J. Recla
*Assistant Examiner*—R. M. Fetsuga
*Attorney, Agent, or Firm*—George C. Atwell

[57] ABSTRACT

For a toilet structure or lavatory bowl having a hinged seat and lid, a device is provided for attachment on the lid undersurface for automatically starting the seat to pivot on its hinge from its upright and toward its horizontal position. The device comprises a planar base secured to the lid and a movable element preferably carried at the end of a leaf spring projecting at an acute angle to the base. The movable element is temporarily adhered to the outer surface of the base when it is driven into contact therewith by the force of the seat being pivotally raised to its upright position. The adherence of the movable member to the base is adapted to be automatically released after a brief time delay whereby it snaps back to its original normal position, thereby impacting against the seat and causing the seat to pivot a sufficient distance from its generally upright position whereby the force of gravity completes the return of the seat to its horizontal disposition.

14 Claims, 1 Drawing Sheet

TOILET SEAT RETURN DEVICE

BACKGROUND OF THE INVENTION

This invention relates generally to apparatus capable of storing energy from the motion or impact of an adjacent movable member and causing a countermovement of the movable member as a function of the release of the stored energy. The invention more particularly pertains to a device for disposition between two adjacent hinged members and for storing energy resulting from the two hinged members being brought together and thereafter causing one of the hinged members to move away from the other as a consequence of the release of the stored energy.

In the typical residential bathroon, a lavatory assembly is provided including a toilet bowl and water storage tank. A lid and seat combination is usually provided to close over the toilet bowl and to be pivotally moved from a closed horizontal position to a generally vertical or just past vertical open position on a common pivot or hinge arrangement connected at the rear of the bowl just forward of the storage tank. It is common practice for male users of the facility to place both the lid and seat in the upright position for urination whereas such disposition is not required by female users. It is not unusual for a male user to neglect returning the seat to its horizontal disposition after use and this is an irritant to both the subsequent female user and to the fastidious homemaker.

The foregoing problem has been variously addressed in the prior art by provision of warning devices which are actuated by the manual raising of the toilet lid to its upright position. Such devices may emit an audible and/or visual warning signal which can only be interrupted by manual return of the seat to its horizontal position. The obvious purpose of such a device is to remind the male user of the facility of his negligence and, hopefully, cause him to properly position the seat whereby the signal will be interrupted. There is no question that such devices are novel and suitable for their intended purpose, however, they can also constitute an irritant to both the conscientious and negligent male user of the facility.

SUMMARY OF THE INVENTION

The present invention comprehends the provision of a device for automatically returning a toilet seat from its upright to its horizontal position after a suitable time lag to permit male use of the facility. The device preferably has a relatively small flat member or base with means for securing it to the undersurface of the toilet lid in alignment with the adjacent seat surface at a point remote from the common hinge arrangement which supports the lid and seat for pivotal movement. The device further includes a movable member preferably supported from the base by an energy storing means such as a spring. The movable member is adapted to be moved between a first position where it is spaced a relatively short distance from the base and a second position where it is in firm contact with the base. The movement of the movable member from its first position (herein referred to as its "normal" position) to its second position is effected by pivotal movement of the toilet seat from its horizontal position to its upright position generally against the open upright lid. The movable member is adapted to adhere to the base for a predetermined time, when the seat is swung upwardly against the lid, and has means associated with it for effecting its release and return movement whereby, in returning from its second to its first position, it imparts a moving force to the seat, with the initial pivotal motion of the seat being continued by the force of gravity so that the seat falls back to its horizontal disposition.

The movable member of the device is preferably a suction cup having its suction face oriented toward the base. The suction cup is preferably held in its normal position by a leaf spring extending at an acute angle from the base, with the suction cup being attached to the projected end of the spring. The leaf spring constitutes an energy storing means which is actuated when the toilet seat is manually pivoted from its horizontal to its upright position to push the suction cup and cause it to adhere to the face side of the base. The suction cup has a small perforation or aperture through its body which serves as a slow-acting bleed hole to enable ambient air to pass through the body to the cup face as a slow gradual flow. As the reduced air pressure in the cavity of the adhering cup face moves toward equalization with atmospheric pressure, the flexed spring ultimately overcomes the cup's adherence and permits the cup to spring away from the base and back to its normal position. This return motion of the cup is translated as a force against the seat and the seat reacts by moving away from the lid a sufficient distance that the seat will then fall back to its horizontal disposition.

The concept of utilizing a suction cup having an air leakage perforation through its body to effect a reaction on a closure member is known in the prior art, as disclosed in U.S. Pat. No. 4,053,961, issued Oct. 18, 1977. That patent teaches the use of a suction cup adapted for delayed suction release. The cup is affixed to the surface of a door whereby its suction face will temporarily adhere to an adjacent wall surface when the door is swung open and hold it open until the suction adherence breaks whereby the door can swing back to its closed position. The patent disclosure does not comprehend the concept of the cup being propelled upon its release by a biasing means to impart a positive driving force against an adjacent hinged closure member, as hereinafter disclosed and claimed.

In one form of the invention, the means for securing the device heretofore described in its operative position is preferably a pressure-sensitive adhesive surface on the back side of the base, disposed such that its bonding characteristics are enhanced by the function of the device.

In another form of the invention, a U-shaped clip is provided for mounting the base in its operative position, with provision of attachment means between the base and the clip member.

Various objectives, as well as specific characteristics and features of the structure of the present invention will be best understood from the ensuing detailed description, particularly when read with reference to the various figures of the accompanying drawings.

DETAILED DESCRIPTION OF THE PREFERRED EMBODIMENTS

Figure 1:
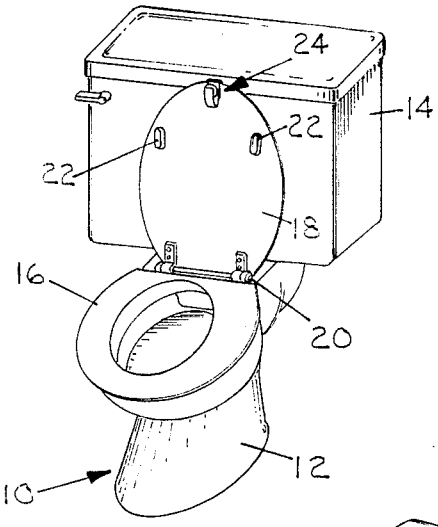
FIG. 1 is a perspective view principally illustrating the environment wherein the present invention is utilized.

FIG. 1 illustrates a typical toilet or lavatory facility 10, including a floor-mounted toilet bowl 12 and a rearwardly disposed water storage tank 14. Shown on the upper open end of the toilet bowl 12 is an annular seat 16. A cover or lid 18 is shown in its upright position against the face of the storage tank 14. Both the seat 16 and the lid 18 are pivotal on a common hinge arrangement 20 at the rear of the bowl structure 12. The visible underside of the lid 18 has a pair of resilient bumpers 22 which, when the lid is in its horizontal "down" position, contact the upper surface of the seat 16 and serve to maintain a small uniform space between the seat 16 and the cover 18. At the upper end of cover 18, as shown in FIG. 1, a device 24, constituting a presently preferred embodiment of the present of the invention, is secured in its operative position.

Figure 2:
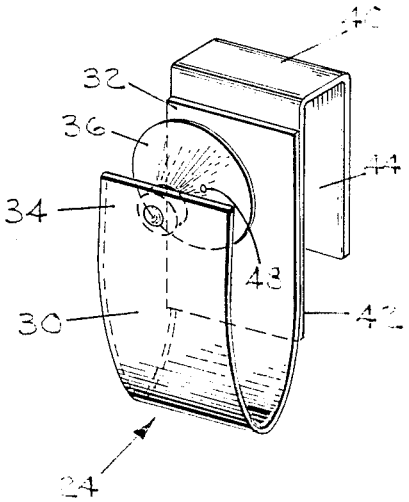
FIG. 2 is a perspective view of a presently preferred embodiment of the device of the present invention.
Figure 3:
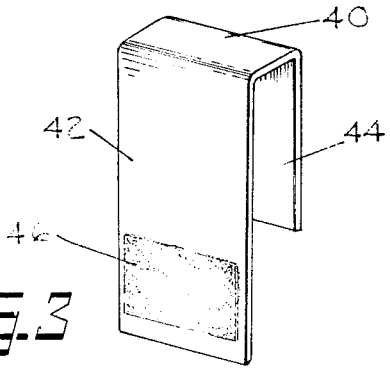
FIG. 3 is a perspective view of an optional component of the structure first shown in FIG. 2.

FIG. 2 illustrates details of the structure of the device 24 first shown in smaller scale in FIG. 1. The device 24 comprises a base 30 preferably fabricated and heat-formed from substantially thin sheet plastic into a generally V-shaped member having spaced legs 32 and 34. On the inwardly-facing surface of leg 34, adjacent its end, is a relatively small suction cup 36 having its suction face oriented toward the surface of leg 32. The device illustrated in FIG. 2 also includes a U-shaped semiflexible clamping member or clip 40 having spaced legs 42 and 44. The clip 40 may be fabricated from the same material and in a similar fashion as the base 30. Between the leg 32 of the base 30 and the leg 42 of the clip 40 is an adhesive coating 46 as more specifically shown in FIG. 3. The clip 40 is designed to permit mounting of the device 24 at the edge of lid 18 by sliding the clip 40 over the lid edge whereby the legs 42 and 44 tend to clamp the device onto the lid. The adhesive surface 46 provided on the leg 42, which may alternatively be provided on the outer surface of leg 32 of the base 30, enables the installer of the device to selectively position the base on the leg 42 of the clip 40 in its best operative position relative to the toilet seat which is to be effected by the device as hereinafter further described. Although a pressure-sensitive adhesive means is preferred for attaching the base 30 to the clip 40, other mechanical attachment means could be utilized or, alternatively, the clip 40 and the base 30 could be a single unit structure.

Figure 4:
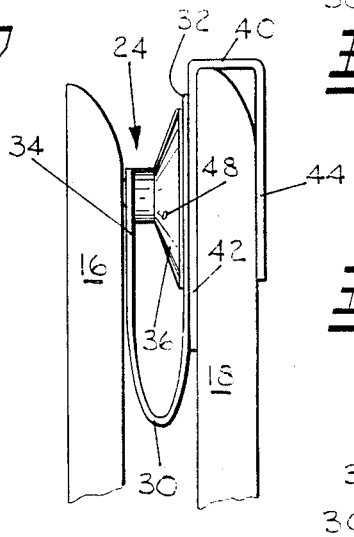
FIG. 4 is a view in vertical elevation illustrating the invention embodiment shown in FIG. 2 in operation.

FIG. 4 illustrates the installed disposition of the device 24 and its operation. With the toilet lid 18 already in its upright position, moving the seat 16 to its upright position toward the lid 18 forces the base 30 to close, with its leg 34 acting as a biasing means or spring member to flex toward the lid whereby the cup 36 is caused to impact against the inner surface of the leg 32 where it spreads and adheres by suction to such surface. The body of the cup 36 has a perforation or bleed hole 48 which extends from the outer surface of the cup body through to the suction face. The perforation 48 is a substantially narrow pinhole which, when the suction cup has been actuated to adhere to the flat base surface, allows ambient air to gradually seep into the center cavity defined by the base of the cup and the base surface thereunder. When the air pressure within the cavity approaches equalization with atmospheric pressure, the energy stored in the flexed leg 34 of the base 30 overcomes the remaining suction and springs the cup 36 back to its original position as shown in FIG. 2. Such action imparts a force between the end of the spring member 34 and the surface of the seat 16 whereby the seat is dislodged from its upright position and begins to pivot on the hinge 20 as shown in FIG. 1, to the left as shown in FIG. 4. This action causes the seat 16 to swing past the vertical whereby it will fall from the force of gravity back to the horizontal position shown in FIG. 1.

Figure 6:
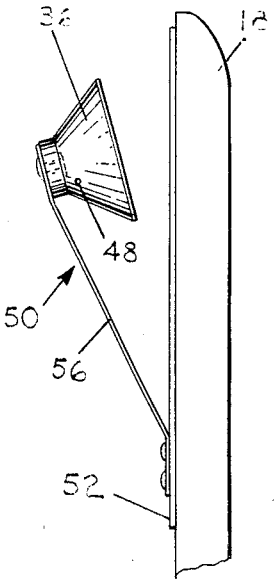
FIG. 6 is a side elevational view of the device first shown in FIG. 5.
Figure 7:
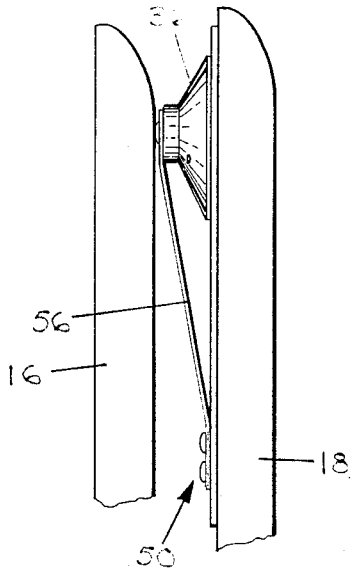
FIG. 7 is a side elevational view similar to FIG. 6 but showing the illustrated device of FIG. 6 during its operation.
Figure 5:
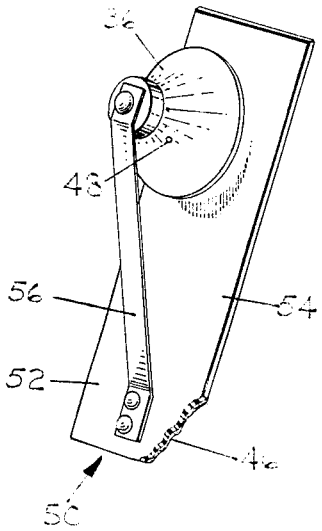
FIG. 5 is a perspective view of an alternate embodiment of a device in accordance with the present invention.

FIGS. 5, 6, and 7 illustrate an alternate form or embodiment for the present invention. The device as shown in FIG. 5 comprises a flat rectilinear base member 52 having a planar face surface 54. A leaf spring 56 is attached at one end to the base member 50 and projects at an acute angle to the face surface 54. In this form of the invention device, the suction cup 36 is fixed to the outer or distal end of the spring member 56. Substantially the entire under surface of the base member 50 is provided with a pressure-sensitive adhesive 46 as shown in FIG. 5 whereby the device 50 may be installed by pressing it firmly against the flat surface of the lid 18, to adhere in its operative position.

The device 50 operates in the same manner as heretofore described with reference to the device 24 shown in FIG. 2. A primary difference between the two embodiments is that the spring member 56, which may be a metal leaf spring or formed from plastic, is not an integral extension of the base member 52 but is attached thereto by suitable rivets. The attachment may be accomplished by an appropriate cement or glue composition, and various means may be employed for attaching the cup 36 to the distal end of the spring member 56.

In both illustrated embodiments of the invention device, the pressure-sensitive adhesive utilized on device 50 for adhering the base member 52 to the lid 18 and in the device 24 for adhering the base 30 to the clamp 40, it is disposed to be subjected to the force of the cup 36 being driven to its suction adherence position whereby the adherence characteristic of the pressure-sensitive adhesive is constantly reinforced through the operation of the device.

In both forms of the invention device, a constituent part of the device structure serves as an energy storing means for effecting the desired return motion of the suction cup to its normal position at the end of the time delay accomplished by the bleed hole in the suction cup. Accordingly, in both forms of the device, the outer end of the flexing member 56 (FIG. 5) or the leg 30 (FIG. 2), with the suction cup affixed thereto, constitutes a movable member for actuating, as a function of manually raising the seat to its upright position, the storage of energy, and the suction cup operates as a latching means which is released after a time delay to thereby permit release of the stored energy which is imparted to the movable member as a force outwardly against the toilet seat, causing it to react and close.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. For a toilet having a hinged seat and lid, a device for automatically starting the seat to pivot from its upright position toward its horizontal position, comprising:

a base having securement means for mounting it against the undersurface of the lid;

energy-storing means, including a movable member having a projecting end which in a first position is spaced from the base, for actuation as a function of manually raising the seat to its upright position, to cause it to store energy;

time-delay releasable latching means in operative connection with the energy-storage means for delaying the release of the energy stored by the energy-storage means; and the releasable latching means being adapted to retain the projected end of the movable member in a second position closer to the base than the first position and allow release of the stored energy which biases the movable member against the seat upon lapse of the time-delay and cause the seat to pivot from the upright to the horizontal position.

2. The device of claim 1 wherein the base has a back side including a generally planar area, and the means for securing the base to the undersurface of the lid is an adhesive coating provided on the planar area.

3. The device of claim 2 wherein the adhesive is pressure sensitive whereby pressure of the cover translated to the base, with the adhesive coating against the surface of the lid, increases the strength of the securement of the base to the lid.

4. The device of claim 1 wherein the means for securing the base to the lid is a clip portion extending from the base which is adapted to clamp to the edge of the lid.

5. The device of claim 1 wherein the releasable latching means comprises a suction cup.

6. The device of claim 5 further comprising a small bleed hole through the body of the suction cup for accomplishing the time-delay release of the latching means.

7. The device of claim 1 wherein the securement means is a generally U-shaped spring clip.

8. The device of claim 1 wherein the energy-storing means is a spring.

9. The device of claim 8 wherein the spring is integral to the base.

10. The device of claim 1 wherein the energy-storing means and the latching means are in fixed connection and constitute the movable member.

11. The device of claim 1 wherein the base has a back side with a planar area for contiguous connection to the undersurface of the lid and an oppositely-facing front side for supporting the latching means, the energy-storing means comprises an elongated leaf spring having a first end fixed to a point on the face side of the base, the leaf spring being oriented at an acute angle to the face side of the base whereby its second end, when the spring is unstressed, is spaced away from the face of the base a predetermined distance.

12. The device of claim 11 further including a suction cup fixedly secured to the second end of the leaf spring and having a face surface oriented generally toward the front side of the base, and the time-delay means comprises a small perforation through the body of the suction cup whereby, when the toilet seat and lid are both manually raised to their upright position, force of the toilet seat toward the lid impacts on the spring's second end and forces the suction cup to move and adhere to the base until sufficient ambient air bleeds through the perforation to permit the stored energy in the spring to overcome the cup adherence such that the spring returns to its unflexed position and pushes the toilet seat a sufficient distance that gravity causes the toilet seat to pivot to its horizontal position.

13. For a toilet having a hinged seat and lid, a device for automatically causing the seat to begin its pivot motion from its upright position, comprising:

a base having means for retaining it on the under side of the lid at a point between the lid and the toilet seat;

a leaf spring projecting from, and overlying the base whereby its projected end is spaced from the base;

a suction cup fixedly attached to the projected end of the leaf spring whereby the suction cup is spaced a predetermined distance from the base;

the suction cup and spring being oriented such that raising the toilet seat upright and to the limit of its pivot toward the lid causes the spring to flex toward the base whereby the face of the suction cup impacts the base and adheres thereto; and a bleed hole through the body of the cup permitting a relatively slow flow of air therethrough, at a predetermined rate, to permit the spring to gradually overcome the cup suction and return to its unflexed position.

14. The device of claim 13 wherein the spring is an integral extension of the base.

* * * * *